US008240290B2

(12) United States Patent
Miyake et al.

(10) Patent No.: US 8,240,290 B2
(45) Date of Patent: Aug. 14, 2012

(54) CONTROL APPARATUS FOR INTERNAL COMBUSTION ENGINE

(75) Inventors: Takao Miyake, Hitachi (JP); Masahiro Toyohara, Hitachiota (JP); Tomohiro Ohisa, Hitachinaka (JP); Yoshikazu Ishii, Hitachinaka (JP)

(73) Assignee: Hitachi Automotive Systems, Ltd., Hitachinaka-Shi (JP)

( * ) Notice: Subject to any disclaimer, the term of this patent is extended or adjusted under 35 U.S.C. 154(b) by 499 days.

(21) Appl. No.: 12/617,327

(22) Filed: Nov. 12, 2009

(65) Prior Publication Data

US 2010/0122690 A1 May 20, 2010

(30) Foreign Application Priority Data

Nov. 14, 2008 (JP) ..... 2008-291629

(51) Int. Cl.
*F02M 57/02* (2006.01)
*F02M 51/00* (2006.01)

(52) U.S. Cl. ..... 123/446; 123/458; 123/479; 123/496; 123/198 D; 123/198 DB; 701/104; 701/107

(58) Field of Classification Search ..... 123/446, 123/447, 496, 510–511, 479, 882, 488, 457, 123/458, 459; 701/104, 107, 112, 114
See application file for complete search history.

(56) References Cited

U.S. PATENT DOCUMENTS 4,733,640 A * 3/1988 Laufer et al. ..... 123/198 D
4,765,299 A * 8/1988 Wataya et al. ..... 123/339.15
5,201,294 A * 4/1993 Osuka ..... 123/458
5,441,026 A * 8/1995 Akimoto ..... 123/198 D
5,727,515 A * 3/1998 Biester ..... 123/198 D
5,727,516 A * 3/1998 Augustin et al. ..... 123/198 DB
5,893,352 A * 4/1999 Fujiwara ..... 123/479
6,142,747 A * 11/2000 Rosenau et al. ..... 417/251
6,283,108 B1 * 9/2001 Matsufuji et al. ..... 123/690
6,378,498 B2 * 4/2002 Kohketsu et al. ..... 123/447
6,446,609 B2 * 9/2002 Mizuno et al. ..... 123/479
6,655,360 B1 12/2003 Joos et al.
6,684,856 B2 * 2/2004 Tanabe et al. ..... 123/447
6,714,853 B2 3/2004 Geyer et al.

(Continued)

FOREIGN PATENT DOCUMENTS

DE 199 51 132 A1 5/2001

(Continued)

OTHER PUBLICATIONS

European Search Report dated Mar. 26, 2010 (Six (6) pages).

(Continued)

*Primary Examiner* — Thomas Moulis
(74) *Attorney, Agent, or Firm* — Crowell & Moring LLP

(57) ABSTRACT

In a control apparatus for an internal combustion engine, when a fuel pressure detected by the fuel pressure detecting unit is not smaller than a threshold P_a, the value opening time duration of a injector is increased to a value larger than its normal value, such control as to stop fuel injection from the injector is inhibited, the low pressure fuel pump is stopped, thus quickly lowering the fuel pressure. After the fuel pressure is lowered, the valve opening time duration of the injector is returned to the normal value, and a discharge quantity of the low pressure fuel pump is changed on the basis of a difference between the fuel pressure detected by the fuel pressure detecting unit and a target fuel pressure.

6 Claims, 10 Drawing Sheets

U.S. PATENT DOCUMENTS

| | | | | |
|---|---|---|---|---|
| 6,715,468 | B2 * | 4/2004 | Uchiyama et al. | 123/339.15 |
| 6,948,480 | B2 * | 9/2005 | Eser et al. | 123/495 |
| 6,964,262 | B2 * | 11/2005 | Hayakawa | 123/458 |
| 7,137,294 | B2 * | 11/2006 | Eser et al. | 73/114.51 |
| 7,281,520 | B2 * | 10/2007 | Klenk et al. | 123/446 |
| 7,444,993 | B2 * | 11/2008 | Hofmeister | 123/479 |
| 7,950,371 | B2 * | 5/2011 | Cinpinski et al. | 123/446 |
| 8,024,104 | B2 * | 9/2011 | Mueller et al. | 701/104 |
| 8,050,845 | B2 * | 11/2011 | Katsura | 701/103 |
| 2002/0117150 | A1 * | 8/2002 | Sykes | 123/458 |
| 2004/0200456 | A1 * | 10/2004 | Eser et al. | 123/458 |
| 2006/0243244 | A1 * | 11/2006 | Kasbauer et al. | 123/333 |
| 2007/0079792 | A1 * | 4/2007 | Dingler et al. | 123/198 D |
| 2007/0079808 | A1 * | 4/2007 | Takahashi | 123/447 |
| 2008/0006245 | A1 * | 1/2008 | Casarella et al. | 123/479 |
| 2009/0151700 | A1 * | 6/2009 | Kondoh | 123/457 |
| 2011/0030655 | A1 * | 2/2011 | Kaneko | 123/456 |
| 2011/0231083 | A1 * | 9/2011 | Saruwatari et al. | 701/107 |
| 2012/0095669 | A1 * | 4/2012 | Katsurahara | 701/107 |

FOREIGN PATENT DOCUMENTS

| | | | |
|---|---|---|---|
| DE | 10 2005 012 997 | A1 | 9/2006 |
| EP | 0 764 777 | A2 | 3/1997 |
| EP | 0 896 144 | A2 | 2/1999 |
| EP | 1 273 783 | A2 | 1/2003 |
| EP | 1 574 704 | A2 | 9/2005 |
| JP | 10-299600 | A | 11/1998 |
| JP | 3237567 | B2 | 10/2001 |
| JP | 2005-256703 | A | 9/2005 |
| JP | 3972823 | B2 | 6/2007 |
| WO | WO 2006/100207 | A1 | 9/2006 |
| WO | WO 2008/003717 | A1 | 1/2008 |

OTHER PUBLICATIONS

Japanese Office Action Dated Mar. 1, 2011 with English translation (Six(6) pages).

* cited by examiner

CONTROL APPARATUS FOR INTERNAL COMBUSTION ENGINE

BACKGROUND OF THE INVENTION

The present invention relates to an internal combustion engine which includes a high pressure fuel pump for supplying a high pressure fuel and fuel injectors and more particularly, to a control apparatus for such an internal combustion engine (which will be referred to as an engine, hereinafter) which can reliably reduce a fuel pressure in high pressure fuel pipe.

Such an engine of a cylinder injection type as to directly inject a high pressure fuel into a cylinder is already known. The fuel is forcedly supplied to the engine by a low pressure fuel pump provided to a fuel tank of a vehicle. The engine is provided with a high pressure fuel pump, the supplied fuel is further compressed to a high pressure by a driving force from the engine, and then supplied to high pressure fuel pipe having fuel injectors mounted thereto.

In recent years, there is such a demand as to increase a discharge efficiency of a high pressure fuel pump, decrease a friction and make the fuel pump compact and light in weight. In order to meet such a demand, a high pressure fuel pump for adjusting a discharged fuel quantity by controlling a charged fuel quantity has been developed. In this type of high pressure fuel pump, the sucked fuel quantity is controlled by supplying a drive current from a control apparatus of the engine to a solenoid to drive a suction valve.

In such a high pressure fuel pump, when a wire harness for supplying a drive current to the inlet value is broken, control of the inlet value becomes disabled. This is considered to lead to such a situation that the high pressure fuel pump rotatingly driven by the engine supplies an excessive fuel to the high pressure fuel pipe. However, since the high pressure fuel pump or the high pressure fuel pipe is provided with a safety or relief value, the pressure of the fuel will not be increased beyond an valve opening pressure of the relief value, so long as the relief value is put in its normal state.

In a system including the high pressure fuel pump, if any abnormality takes place in the aforementioned relief valve, then it becomes necessary to secure a safety of the system by quickly suppressing an increase in the fuel pressure.

Meanwhile, when abnormal high pressure state continues for a period of a predetermined time as when a fuel pressure in a common rail is higher than a first judgement value corresponding to an allowable pump use limit or as when the fuel pressure is higher than the first judgement value and exceeds such a second judgement value as to cause deterioration of the performance of a fuel supply pump; an abnormality failure in the fuel supply pump is detected. Such a system as to stop an engine after passage of a predetermined time from a time point of detection of an abnormality failure in a fuel supply pump, is already known (for example, refer to Japanese Patent No. 3972823).

It is also known that, when a pressure in fuel within the high pressure fuel pipe at the downstream side of the high pressure fuel pump is detected by a fuel pressure sensor and is at an abnormal level higher than a predetermined pressure, the system is arranged to stop a field pump as a low pressure fuel pump, thereby reliably reducing the internal pressure of the high pressure fuel pipe (refer to Japanese Patent No. 3237567).

SUMMARY OF THE INVENTION

However, it is considered that the function of the relief valve is deteriorated for some reasons so that even when a fuel pressure is at a level not lower than the valve opening pressure, the relief valve cannot discharge the fuel (stuck fault in the relief valve). It is also considered in such a condition that when a breaking or the like in the harness for driving the intake value of the high pressure fuel pump disables control of the intake valve, the fuel pressure is increased up to an abnormal high level because the function of the relief valve is not normal.

The system set forth in Japanese Patent No. 3972823 contends with such a situation by stopping the engine to prevent such an abnormal high pressure state from being continued. However, since this disables the automobile from running, the driver cannot move the automobile to a safe location. Or the driver cannot drive the automobile as far as its automobile dealer for its repair, with a poor convenience.

In the contents disclosed in Japanese Patent No. 3237567, even after the low pressure fuel pump is stopped, fuel still remains within the fuel pipe connected from the low pressure fuel pump to the high pressure fuel pump. This causes the high pressure fuel pump being rotatingly driven forcibly by the engine to continue discharging of fuel to the high pressure fuel pipe. This cannot possibly avoid its abnormal high pressure.

It is therefore an object of the present invention to provide a control apparatus for an internal combustion engine which can avoid an abnormal high pressure even when an quantity of discharged fuel of a high pressure fuel pump cannot be controlled in such a condition that a relief value abnormally functions.

In accordance with the present invention, the above object is attained by providing a control apparatus for an internal combustion engine which includes a high pressure fuel pump for supplying a high pressure fuel to the internal combustion engine, a low pressure fuel pump for supplying a fuel to the high pressure fuel pump, at least one fuel injector for injecting the fuel directly into a cylinder of the engine, a fuel injection controller for driving the high pressure fuel pump and the injector, a high pressure fuel pipe connected between the high pressure fuel pump and the injector, and a fuel pressure detecting unit provided to the high pressure pipe. A total of maximum injection quantities of the injectors or valves mounted to the engine is designed to exceed a maximum discharge quantity of the high pressure fuel pump in a range where the fuel injection controller is normally operated and, when a fuel pressure detected by the fuel pressure detecting unit is not lower than a threshold P_a, a valve opened time duration is controlled so that a total of injection quantities per unit time injected from the injectors is larger than a fuel discharge quantity per unit time discharged from the high pressure fuel pump.

In accordance with the present invention, even in such a double failure situation that a relief valve is not provided or the relief valve abnormally functions (stuck fault) and simultaneously that a suction value for adjusting a quantity of sucked fuel to the high pressure fuel pump becomes faulty and thus a discharge quantity cannot be controlled; the control apparatus can avoid an abnormally high pressure and can continue operating the engine.

Other objects, features and advantages of the invention will become apparent from the following description of the embodiments of the invention taken in conjunction with the accompanying drawings.

DESCRIPTION OF THE EMBODIMENTS

Figure 1:
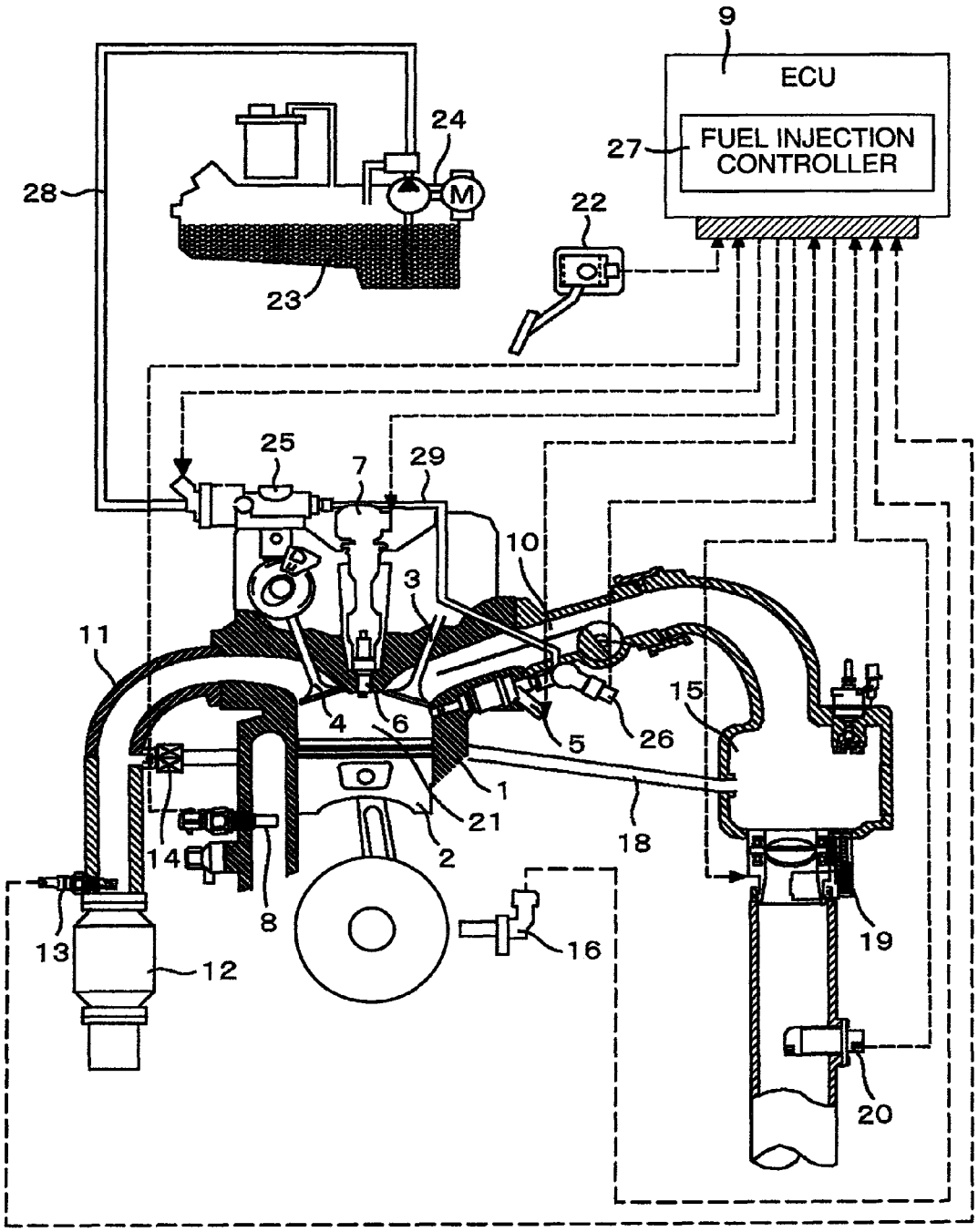
FIG. 1 is an arrangement of an internal combustion engine system including a control apparatus in accordance with an embodiment of the present invention.

In accordance with one embodiment of the present invention, there is provided a control apparatus for an internal combustion engine which includes a high pressure fuel pump for supplying a high pressure fuel to the internal combustion engine, a low pressure fuel pump for supplying a fuel to the high pressure fuel pump, at least one fuel injector for injecting the fuel directly into a cylinder of the engine, a fuel injection controller for driving the high pressure fuel pump and the injectors, a high pressure fuel pipe connected between the high pressure fuel pump and the injector, and a fuel pressure detecting unit provided to the high pressure pipe. A total of maximum injection quantities of the injectors mounted to the engine are designed to exceed a maximum discharge quantity of the high pressure fuel pump in a range where the fuel injection controller is normally operated and, when a fuel pressure detected by the fuel pressure detecting unit is not lower than a threshold P_a, a valve opened time duration is controlled so that a total of injection quantities per unit time injected from the injectors is larger than a fuel discharge quantity per unit time discharged from the high pressure fuel pump.

With such an arrangement, even in such a double failure situation that a relief valve is not provided or the relief valve abnormally functions (stuck fault) and simultaneously that a suction value for adjusting a fuel quantity sucked by the high pressure fuel pump becomes faulty and a discharge quantity cannot be controlled; the control apparatus can avoid an abnormally high pressure and can continue operating the engine.

When a fuel pressure detected by the fuel pressure detecting unit is not lower than a threshold P_a, a fuel stored within the high pressure fuel pipe can be reliably discharged from the injectors by inhibiting stoppage of fuel injection from the injectors. As a result, a pressure in the high pressure fuel pipe can be quickly lowered.

Further, when the low pressure fuel pump is stopped, a fuel supplied to the high pressure fuel pump can be cut, thus reducing a quantity of fuel discharged into the high pressure pipe. This results in that a pressure in the high pressure fuel pipe can be quickly lowered.

When a fuel pressure detected by the fuel pressure detecting unit becomes not higher than a predetermined value lower than the threshold P_a, the control apparatus stops the low pressure fuel pump. With regard to the stoppage of the low pressure fuel pump, it is desirable to stop the low pressure fuel pump when a pressure in the high pressure pipe exceeds the threshold P_a in order to lower a pressure in the high pressure pipe. However, if a pipe connected between the low and high fuel pumps cannot endure a design negative pressure generated when the low pressure fuel pump is stopped, it is preferable to stop the low pressure fuel pump after a pressure in the high pressure pipe reaches a predetermined value in order to minimize the negative pressure influence.

When a fuel pressure detected by the fuel pressure detecting unit is lower than a threshold P_b lower than the threshold P_a, the control apparatus returns the valve opening time duration of the injector to its normal value. This is because lowering of the fuel pressure down to the value P_b can prevent the high pressure pipe from being damaged even when the injector is set at the normal valve opening duration. When the engine is run with the injector set at its normal valve opening duration, the driver can move the automobile to a safe location or can move the automobile by himself or herself as far as a repair factory operated by its automobile dealer without resorting to using a wrecker or the other means. After passage of a predetermined time from the stoppage of the low pressure fuel pump, the valve opening duration of the injector may be returned to its normal value.

When the fuel pressure detected by the fuel pressure detecting unit is lower than a threshold P_c lower than the threshold P_a, the low pressure fuel pump is switched to its operational or stoppage mode on the basis of a difference between the fuel pressure detected by the fuel pressure detecting unit and a target fuel pressure. As a result, the fuel can be continuously supplied from a tank to the high pressure pipe and a distance for the automobile to be moved to the aforementioned safe location can be extended.

When a relief valve is provided, the relief valve can exhibit its normal performance and in its abnormal state, a fuel pressure in the high pressure pipe can be quickly lowered, by setting the threshold P_a to be higher by a predetermined value than the valve opening pressure of the relief value.

When a failure is detected in the relief valve, such a risk that a fuel pressure in the high pressure pipe becomes abnormally high can be reduced by lowering the discharge quantity of the low pressure fuel pump down to its normal level.

When a failure is detected in the relief valve, the threshold P_a can be changed to a value lower than the valve opening pressure of the relief valve, thus minimizing such a risk that the fuel pressure in the high pressure pipe becomes abnormally high.

Explanation will be made in detail as to the arrangement and operation of a control apparatus for an internal combustion engine in accordance with an embodiment of the present invention, by referring to FIGS. 1 to 10.

First by referring to FIG. 1, explanation will be made as to the arrangement of an internal combustion engine system including a control apparatus in accordance with the present embodiment.

An engine 1 includes a piston 2, an intake valve 3, and an exhaust valve 4. A sucked air is sent through an air flow meter (AFM) 20 to a throttle valve 19, and then supplied from a collector 15 as a branch via an intake pipe 10 and an intake valve 3 to a combustion chamber 21 of the engine 1. A fuel is supplied by a low pressure fuel pump 24 from a fuel tank 23 to the engine. The pressure of the supplied fuel is further increased up to a level necessary for fuel injection by a high pressure fuel pump 25. The fuel increased in pressure by the high pressure fuel pump 25 is supplied to an injector 5, injected from the injector 5 into the combustion chamber 21 of the engine 1, and then ignited by an ignition coil 7 and an ignition plug 6. The pressure of the fuel is measured by a fuel pressure sensor 26.

An exhaust gas after combustion is exhausted via the exhaust valve 4 into an exhaust pipe 11. A 3-way catalytic converter 12 for clarifying an exhaust gas is provided to the exhaust pipe 11. A fuel injection controller 27 is built in an ECU (Engine Control Unit) 9. Input to the ECU 9 are a signal from a crank angle sensor 16 of the engine 1, an air quantity signal from the AFM 20, a signal from an oxygen sensor 13 for detecting a concentration of oxygen in the exhaust gas, an accelerator pedal opening signal from an accelerator pedal opening sensor 22, a signal from the fuel pressure sensor 26, and so on. The ECU 9 also includes a rotational speed detecting unit for calculating a rotational speed of the engine on the basis of the signal from the crank angle sensor 16, and a warm-up judging unit for judging whether or not the 3-way catalytic converter 12 is warmed up on the basis of a temperature of water in the engine obtained from a water temperature sensor 8 and a time passed after the start of the engine, and so on.

The ECU 9 also calculates a quantity of intake air necessary for the engine 1 and outputs a corresponding opening signal to the throttle value 19. The fuel injection controller 27 in the ECU 9 also calculates a quantity of fuel in response to the intake air quantity, and outputs a fuel injection signal to the injector 5. The injector 5 in turn outputs an ignition signal to the ignition plug 6.

An EGR (Exhaust Gas Recirculation) passage 18 connects the exhaust pipe 11 and the collector 15. An EGR valve 14 is provided in the course of the EGR passage 18. The opening of the EGR valve 14 is controlled by the ECU 9 so that an exhaust gas in the exhaust pipe 11 is circulated to the intake pipe 10 as necessary.

Figure 2:
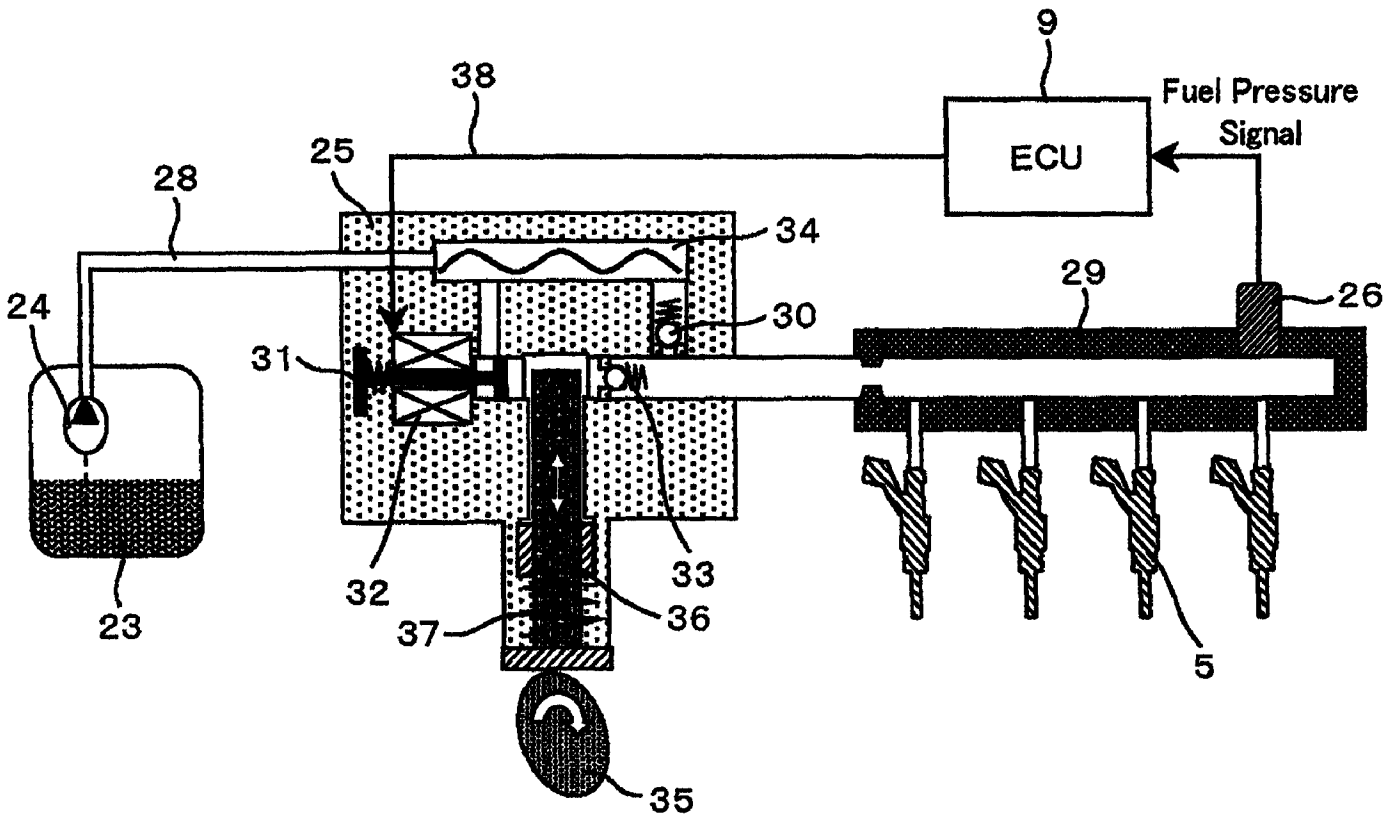
FIG. 2 is an arrangement of a fuel injection system in accordance with the embodiment of the present invention.

FIG. 2 shows, in a model form, a fuel system including fuel pipe and pumps as main components between a fuel tank and injectors. The fuel compressed and supplied by the low pressure fuel pump 24 is attenuated in its pulsating pressure by a damper 34. A plunger 36 is moved down by a spring 37, so that a low pressure fuel is taken in from an end of a fuel passage having a suction valve 31. The plunger 36 is moved up by a pump driving cam 35 driven by the engine to thereby compress the fuel. This increases the pressure of the fuel. When the increased fuel pressure exceeds the pressure of a fuel in a high pressure fuel pipe 29 and the valve opening pressure of a discharge valve 33, the discharge valve is opened so that the compressed fuel is supplied to the high pressure fuel pipe 29.

The control apparatus for the engine adjusts an quantity of discharged fuel so that the pressure of the fuel in the high pressure fuel pipe 29 sensed by the fuel pressure sensor 26 follows up a calculated target fuel pressure. The adjustment of the discharged fuel quantity by controlling the opening/closing timing of the suction valve 31, that is, the timing of distributing power to a solenoid control harness 38 of the suction valve under control of the ECU 9 incorporating the fuel injection controller 27.

A relief valve 30 is built in the high pressure fuel pump 25 to be opened with a predetermined pressure. At this time, the fuel is returned to a fuel pipe 28, which prevents the high pressure fuel pipe 29 from being put in its abnormally high pressure state. In this connection, even when the relief valve 30 is provided to the high pressure fuel pipe 29, the relief valve similarly functions.

Figure 3:
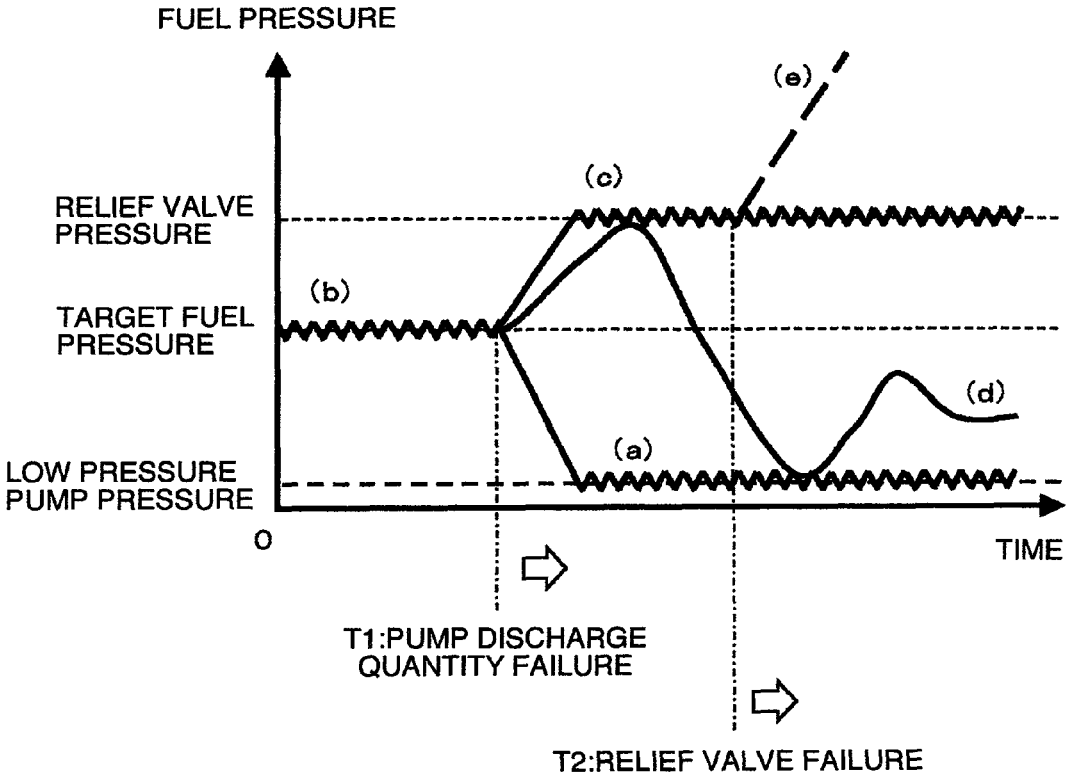
FIG. 3 is a diagram showing transition of fuel pressures considered in a double failure situation.

Explanation will next be made as to a fuel system, in particular, the behavior of a fuel pressure when the high pressure fuel pump 25 and the relief valve 30 malfunction, by referring to FIG. 3. In a time duration of the normal fuel system from a time O to a time T1, the fuel pressure of the high pressure fuel pipe 29 is controlled and set at a target fuel pressure (b). When any of the suction valve 31, a suction valve solenoid 32, the solenoid control harness 38, and the discharge valve 33 is deteriorated in function for some reason at the time T1, the ECU 9 cannot control the fuel discharge quantity of the high pressure fuel pump 25. When the high pressure fuel pump 25 fails to increase the fuel pressure, the pressure of a fuel in the high pressure fuel pipe 29 is decreased down to a level (a) corresponding to the fuel pressure compressed by the low pressure fuel pump. Or when the high pressure fuel pump is put in such a state as to always increase the fuel pressure, the relief valve is opened, so that the fuel pressure in the high pressure fuel pipe 29 is kept at an valve opening pressure (c). Or the fuel pressure becomes unstable or varies in a range of between the pressure levels (a) and (b), as shown by a curve (d).

Explanation will then be made as to the behavior of a fuel pressure when the function of the relief valve is deteriorated at a time T2, in a so-called double failure mode. The deterioration of the function of the relief valve causes the high pressure fuel pump 25 loses its escape passage to escape the continuously compressed fuel. In such a failure state of the high pressure fuel pump as to continuously increase the fuel pressure, when the fuel pressure is kept at the fixed valve opening pressure (c) of the relief valve and also when a quantity of fuel discharged from the high pressure fuel pump exceeds a quantity of fuel injected from the injectors, the fuel pressure of the high pressure fuel pipe 29 may be set undesirably at an abnormally high level (e).

Figure 4:
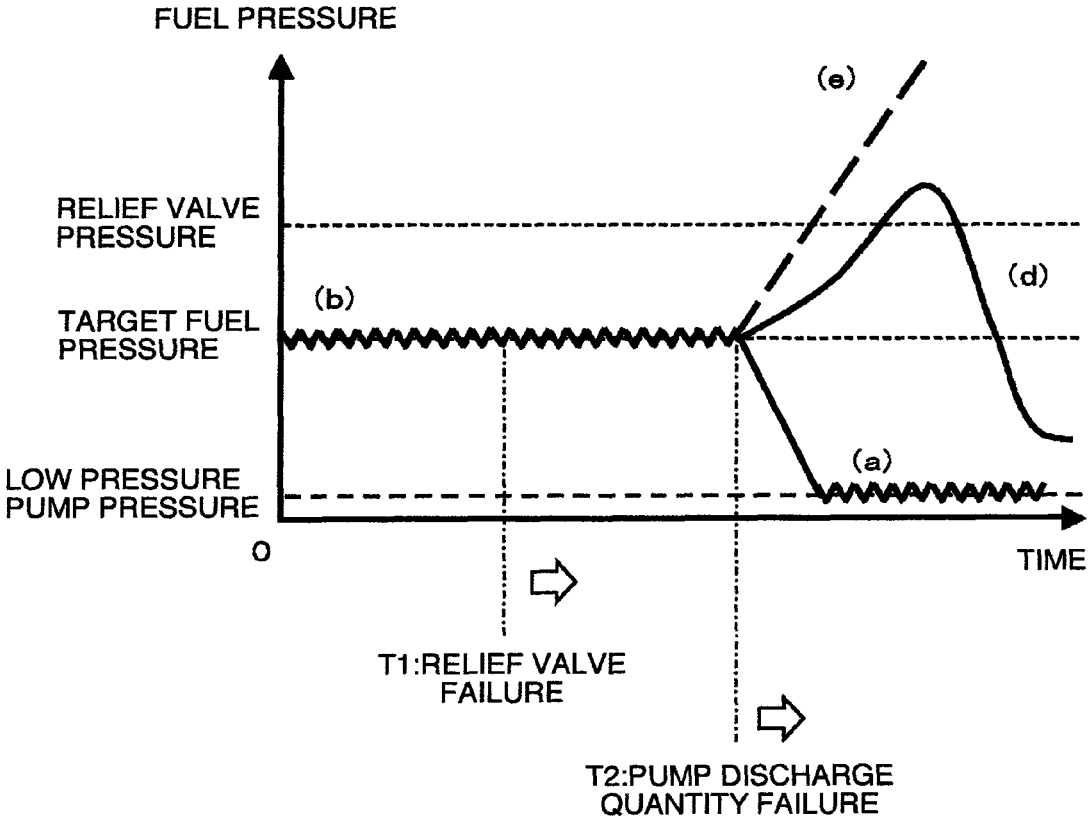
FIG. 4 is a diagram showing transition of fuel pressures considered in a double failure situation.

FIG. 4 shows changes in fuel pressure in another double failure mode. When the function of the relief valve 30 is deteriorated at the time T1, the fuel pressure in the high pressure fuel pipe 29 is controlled and set at the target fuel level (b) as in the normal state, so long as the other constituent elements in the fuel system are normal.

When the function of the high pressure fuel pump is deteriorated and put in such a state as to always increase the fuel pressure at a time T2, the high pressure fuel pump 25 loses its passage to escape the fuel being continuously compressed because the function of the relief valve 30 is deteriorated. At this time, when a quantity of fuel discharged from the high pressure fuel pump exceeds an quantity of fuel injected from the injectors, the fuel pressure of the fuel pipe 28 may become undesirably an abnormally high level (e).

As mentioned above, when single one of the functions of the fuel system is deteriorated, the fuel pressure will not reach such an abnormally high level. However, when the system is put in such a double failure mode as to cause another failure simultaneously with the failure of the relief valve, it is necessary to take a measure against it because this may cause the fuel pressure to reach an abnormally high level. How to take a measure to avoid the double failure mode in the present invention will be explained with reference to FIGS. 5 to 10.

Figure 5A:
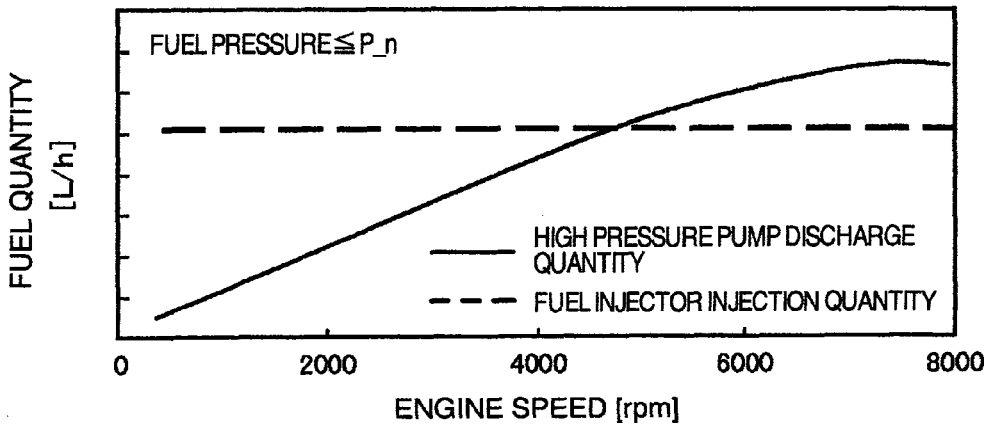
FIGS. 5A to 5C are graphs showing relationships between a maximum discharge quantity of a high pressure fuel pump and a maximum injection quantity of fuel injectors for different fuel pressures in the embodiment of the present invention.
Figure 5B:
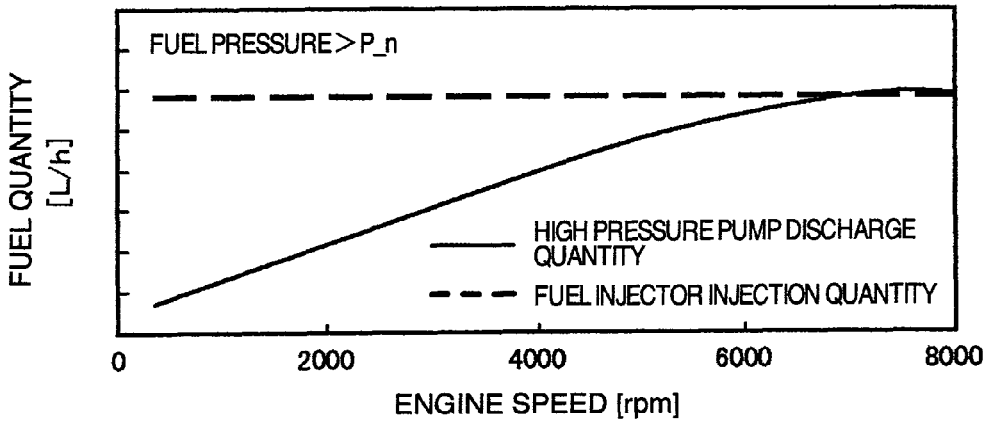
Figure 5C:
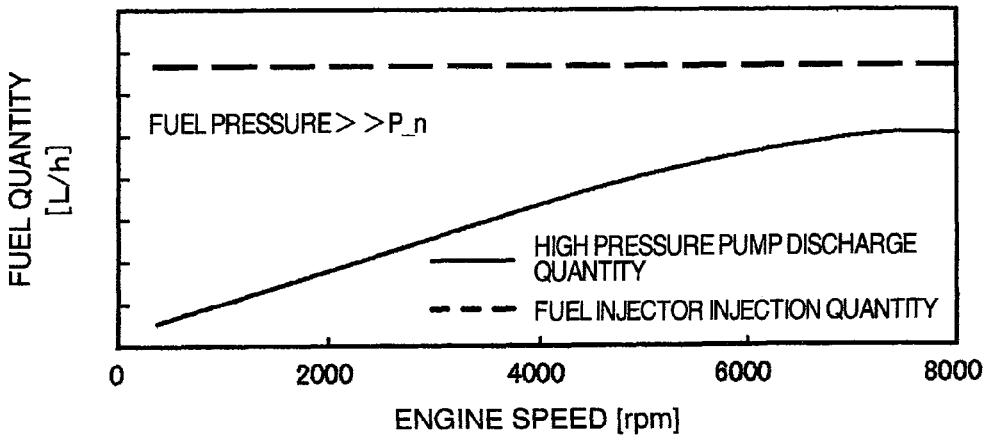

FIGS. 5A to 5C show graphs for explaining comparison between a maximum discharge quantity of the high pressure fuel pump 25 and a total of maximum fuel quantities injected from a plurality of the injectors 5 mounted in an internal combustion engine in a fuel system for use in the present invention. In this connection, the word "maximum fuel quantities of the injectors 5" refers to fuel quantities when the fuel injection controller 27 or the injectors 5 normally function and when a drive current is provided to the injectors 5 only for a power distribution duration in which the respective elements are not damaged. The quantity of fuel injected from the injector 5 is independent of the rotational speed of the engine. This is because the power distribution duration when the fuel injection controller 27 is normally operated is defined by the crank angle of the engine.

When a fuel pressure in the high pressure fuel pipe 29 is not higher than a normal level P_n, the maximum discharge quantity of the high pressure fuel pump exceeds a total value of maximum fuel injection quantities from the injectors 5 in a high engine speed range as shown in FIG. 5A. Since an increase in the fuel pressure causes the discharge valve 33 of the high pressure fuel pump 25 to be opened with a delay, this results in that a discharge efficiency (discharge quantity) for the high pressure fuel pump 25 is decreased. Meanwhile, the fuel injection quantities of the injectors depends upon a difference in internal pressure in a cylinder of the engine so long as valve opening times of the injectors are equal. Thus an increase in fuel pressure causes the injection quantity to also increase. Accordingly, when the fuel pressure is higher than the normal level P_n, the maximum discharge quantity of the high pressure fuel pump 25 becomes close to the maximum injection quantity from the injectors 5 even in the high engine speed range, as shown in FIG. 5B. Further, when the fuel pressure is increased as when the fuel pressure becomes the pressure of the relief valve shown in FIGS. 3 and 4, the maximum injection quantity from the injector 5 exceeds the maximum discharge quantity of the high pressure fuel pump 25 over the entire engine speed range as shown in FIG. 5C.

Figure 6:
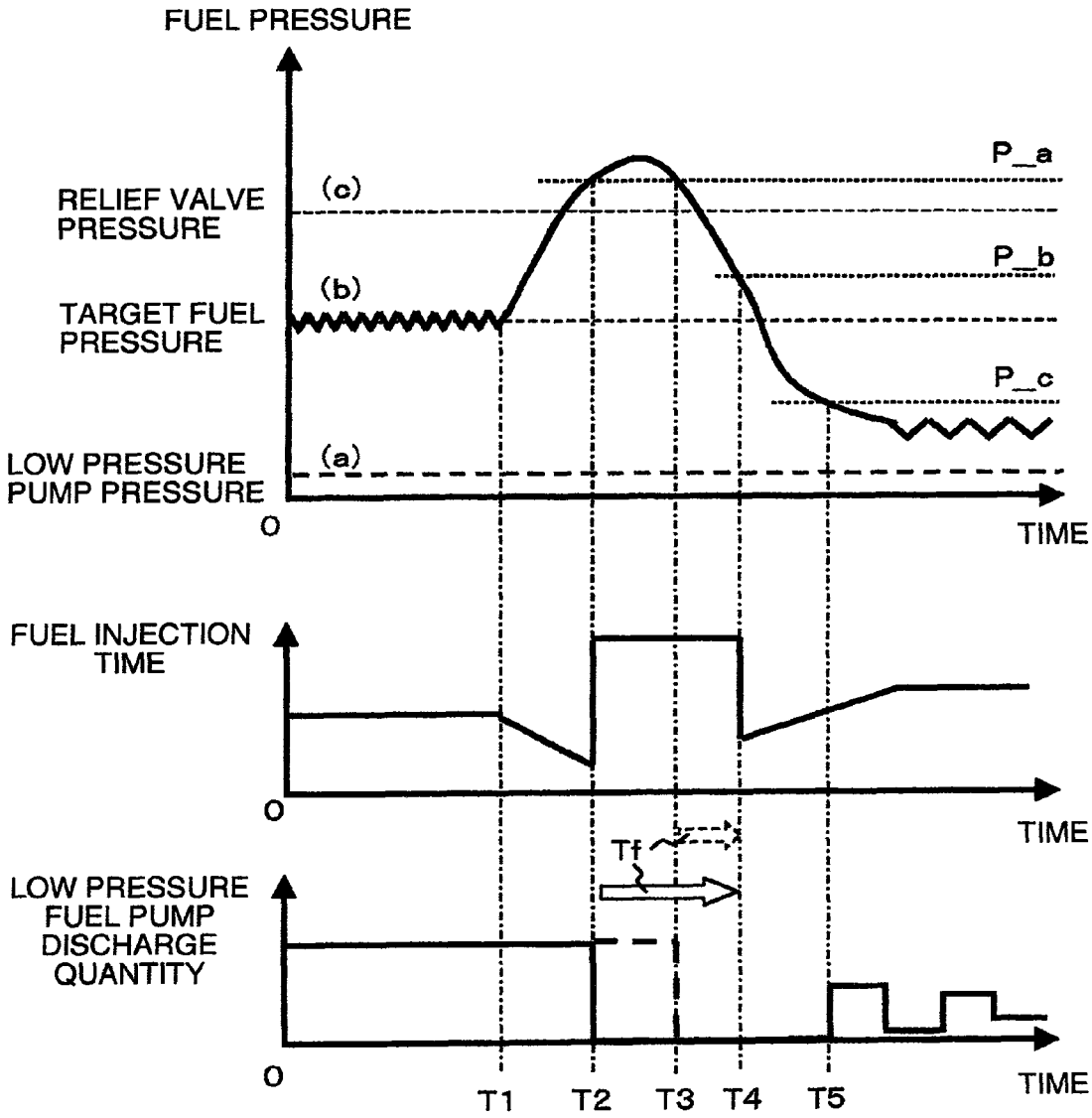
FIG. 6 is a graph showing a relationship among transition of fuel pressures, an injection time duration of the injector, and a discharge quantity of a low pressure fuel pump, considered in a double failure situation in the embodiment of the present invention.

FIG. 6 shows a relationship among the behavior of a fuel pressure, a fuel injection duration of the injector 5, and a discharge quantity from the low pressure fuel pump 24 in a double failure mode when such control as to avoid an abnormal pressure increase is carried out with use of the control apparatus for the engine in accordance with the present invention. When double failures take place at the time T1, a fuel pressure in the high pressure fuel pipe 29 is increased. At this time, since the function of the relief valve is also deteriorated, the fuel pressure increases beyond the valve opening pressure (C) of the relief valve.

Figure 7:
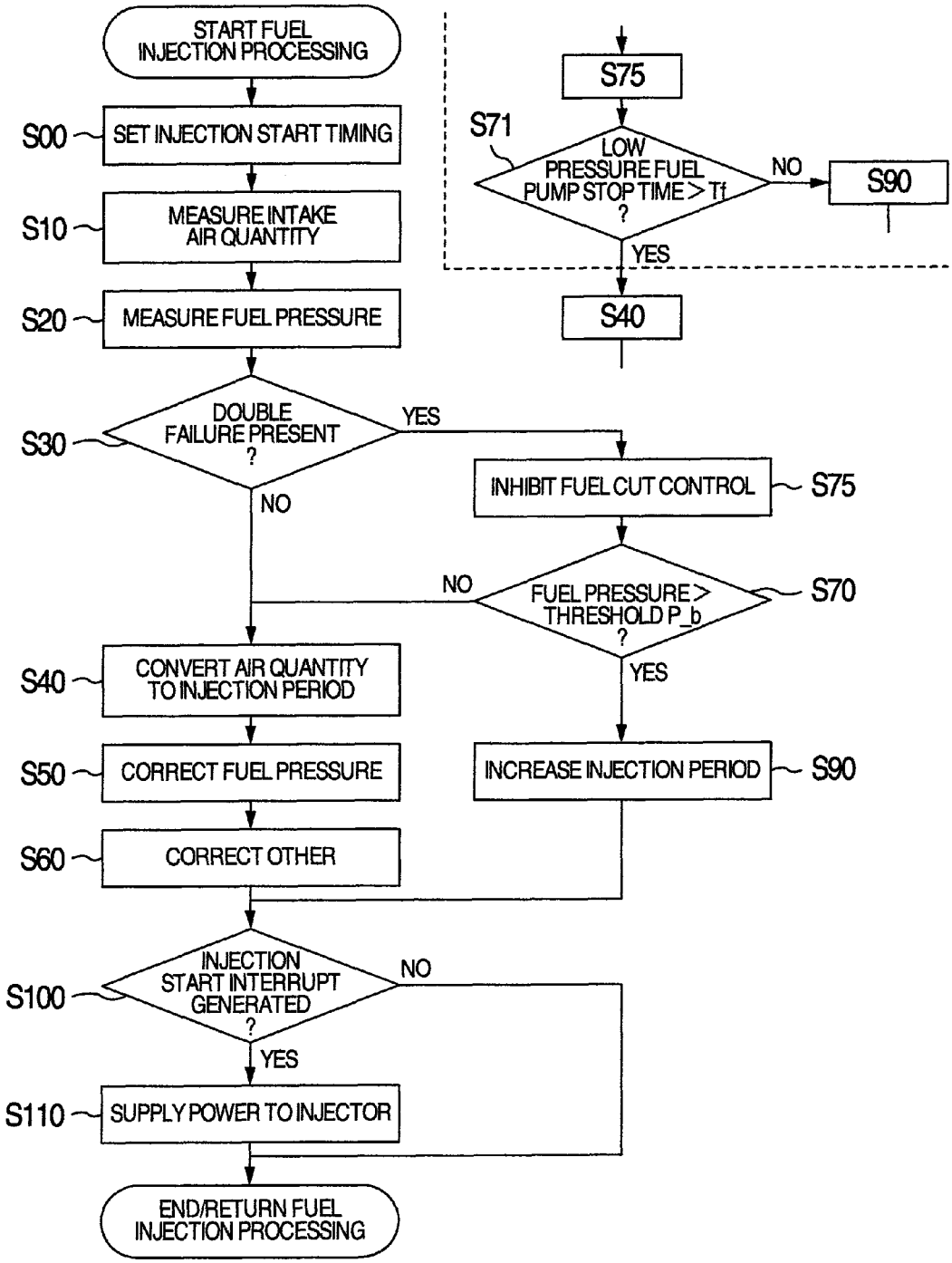
FIG. 7 is a control flow chart of a control apparatus in accordance with the embodiment of the present invention.
Figure 8:
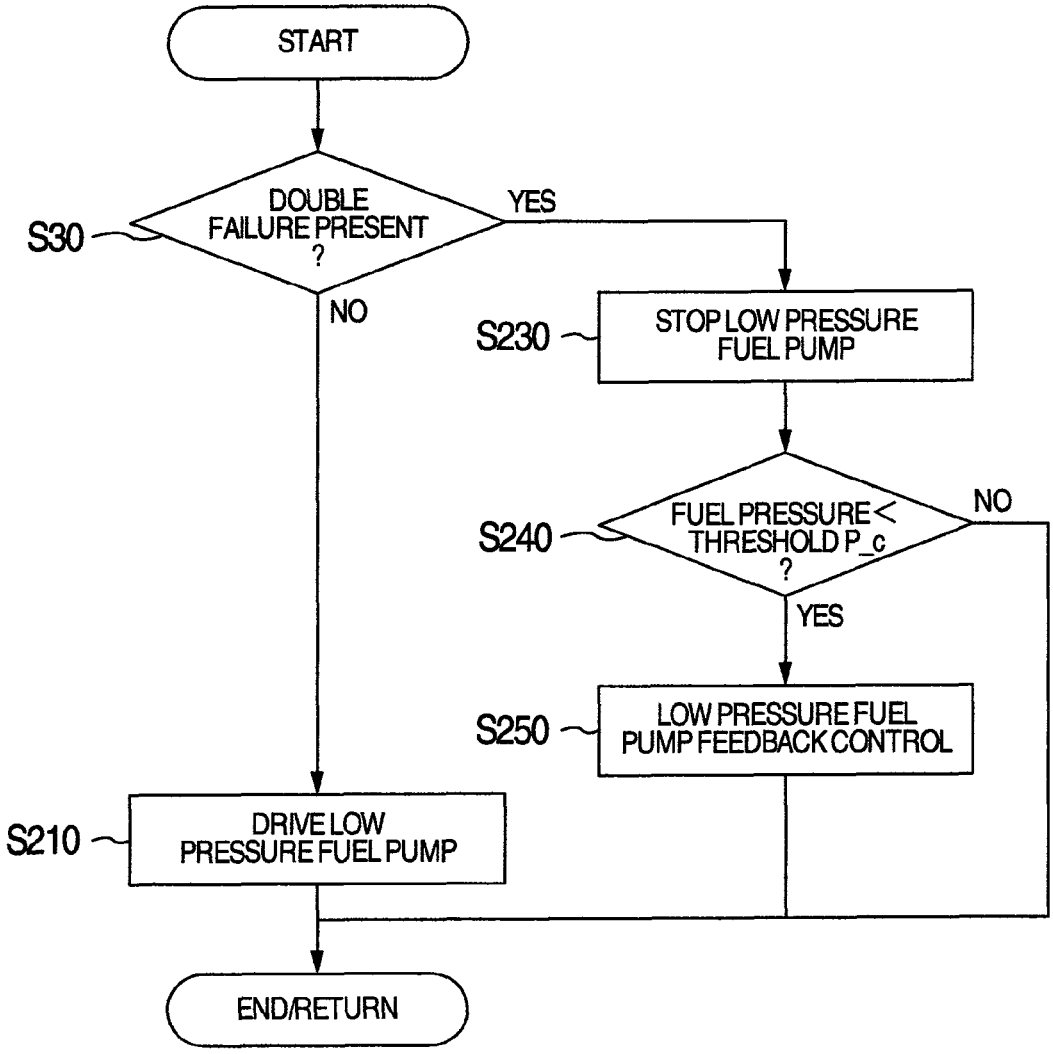
FIG. 8 is a control flow chart of a control apparatus in accordance with the embodiment of the present invention.
Figure 9:
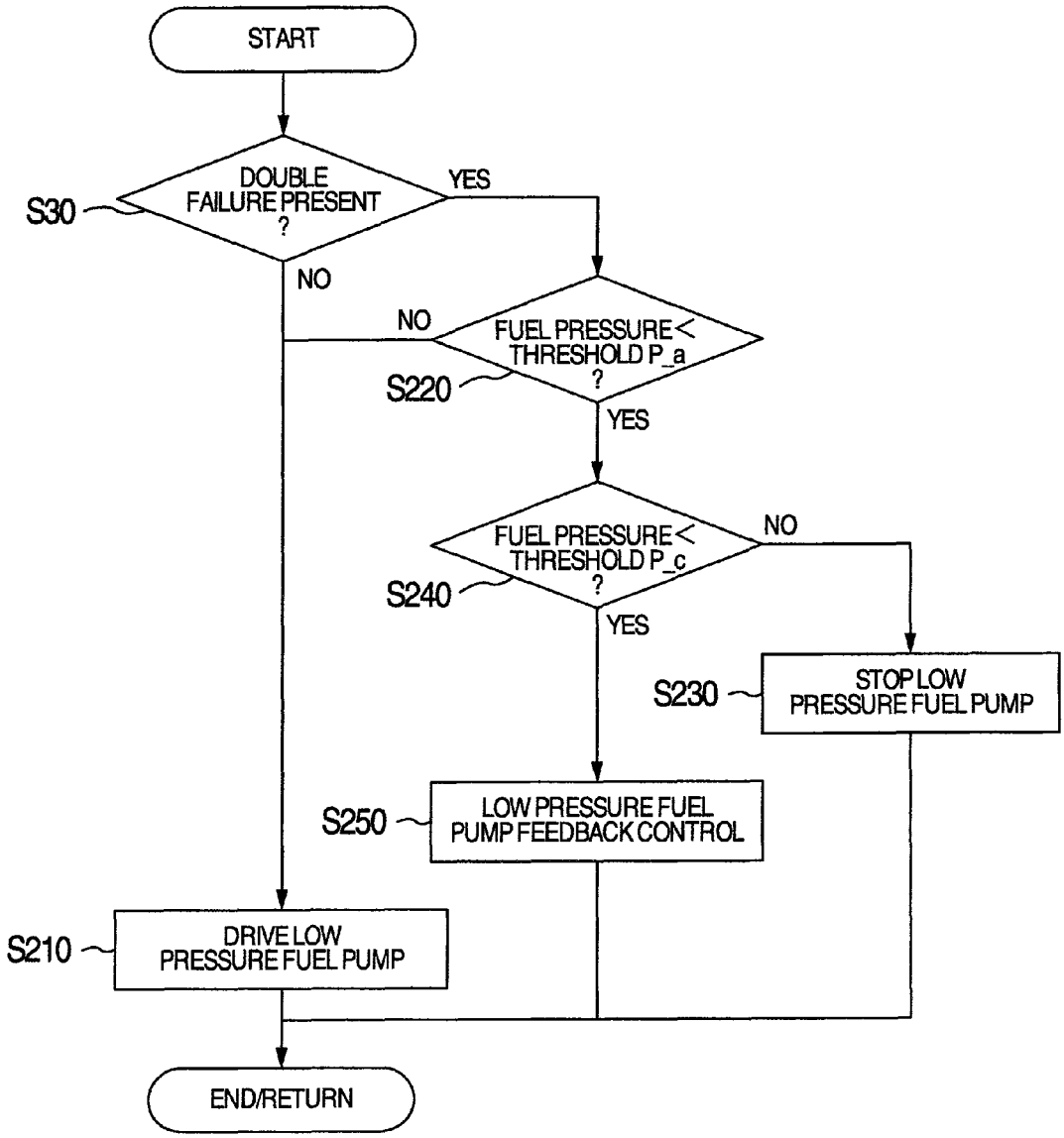
FIG. 9 is a control flow chart of a control apparatus in accordance with the embodiment of the present invention.

How to control the engine in a double failure mode with use of the control apparatus of the present invention will be explained with use of flow charts of FIGS. 7, 8 and 9. Control operation shown by the flow charts of FIGS. 7, 8 and 9 is executed by the ECU 9. Each of the flow charts of FIGS. 7, 8 and 9 shows independent control method respectively. In the flows of FIGS. 7, 8 and 9, steps until a step S30 are common and steps subsequent to the step S30 are different from each other. At the time T2 in FIG. 6, the fuel pressure is sensed by the fuel pressure sensor 26. When the control apparatus recognizes the fact that the fuel pressure exceeds the threshold P_a, the apparatus determines a double failure mode at the step S30 (refer to FIG. 7). After the control apparatus determines the presence of the double failure mode, the apparatus inhibits such fuel cut control as to be carried out at the time of accelerator pedal off at a step S75. So long as the control apparatus determines at the step S70 that the fuel pressure is larger than the threshold P_b shown in FIG. 6, the apparatus sets a power distribution time duration to the injector 5 to be larger than its normal time duration at a step S90. In this case, the power distribution time duration to the injectors 5 is set to be in such a range that the fuel injection controller 27 or the injectors 5 can be normally operated, not leading to their damage.

The step S70, where the fuel pressure is used as a determination reference, may also be replaced with a step S71, where it is determined whether or not a time from stoppage of a low pressure fuel pump shown by a step S230 in FIG. 8 or 9 is larger than a value Tf after the determination of the double failure mode.

At a time t4 in FIG. 6, the control apparatus returns control of the fuel injection time duration to its normal control (steps S40, 50 and 60) at the steps S70 and S71. Since injection of the maximum fuel from the injectors 5 is preferential to flammability performance in a time duration between the time T2 to T4, no combustion takes place, a reduced torque is generated, and the rotational speed of the engine is correspondingly reduced. In the present invention, returning of the control apparatus to the normal injection quantity control at the time T4 to generate a torque and to prevent the engine stall.

In a normal state of the fuel system, the control apparatus calculates a time duration of power distribution to the injectors 5 on the basis of a charge air quantity measured by the AFM 20 at steps S10 and S40 in FIG. 7. The apparatus corrects the fuel pressure, etc. at steps S20, S50, and S60 to correct the power distribution time in order to obtain a suitable quantity of fuel injection. The ECU 9 performs the interrupt operation of a step S100 to start fuel injection with the timing of starting fuel injection set at a step S00, and distributes power to the injectors to cause fuel to be injected from the injectors at a step S110. Through the above operations, a mass ratio between the air and fuel of mixture introduced into the combustion chamber of the engine is kept at a value falling in a suitable range, with secured flammability of the mixture.

In the present invention, on the other hand, when determining the presence of a double failure mode, the control apparatus preferentially reduces a quantity of fuel from the high pressure fuel pipe 29 to reduce the fuel pressure at a step S90 while not paying consideration to the aforementioned flammability performance. For this reason, the power distribution time duration to the injectors 5 is set to be longer than its preset normal time duration regardless of a charge air quantity measured by the AFM 20.

When the fuel pressure of the high pressure fuel pipe 29 is increased beyond the valve opening pressure of the relief valve, the maximum discharge quantity of the high pressure fuel pump 25 and the maximum injection quantity of all the injectors 5 mounted to the engine are as shown in FIG. 5C. That is, since the injection quantity of the injectors 5 exceeds the discharge quantity of the high pressure fuel pump 25, the quantity of fuel in the high pressure fuel pipe can be reduced and the fuel pressure can be reduced at time points subsequent to the time T2 in FIG. 6.

Figure 10:
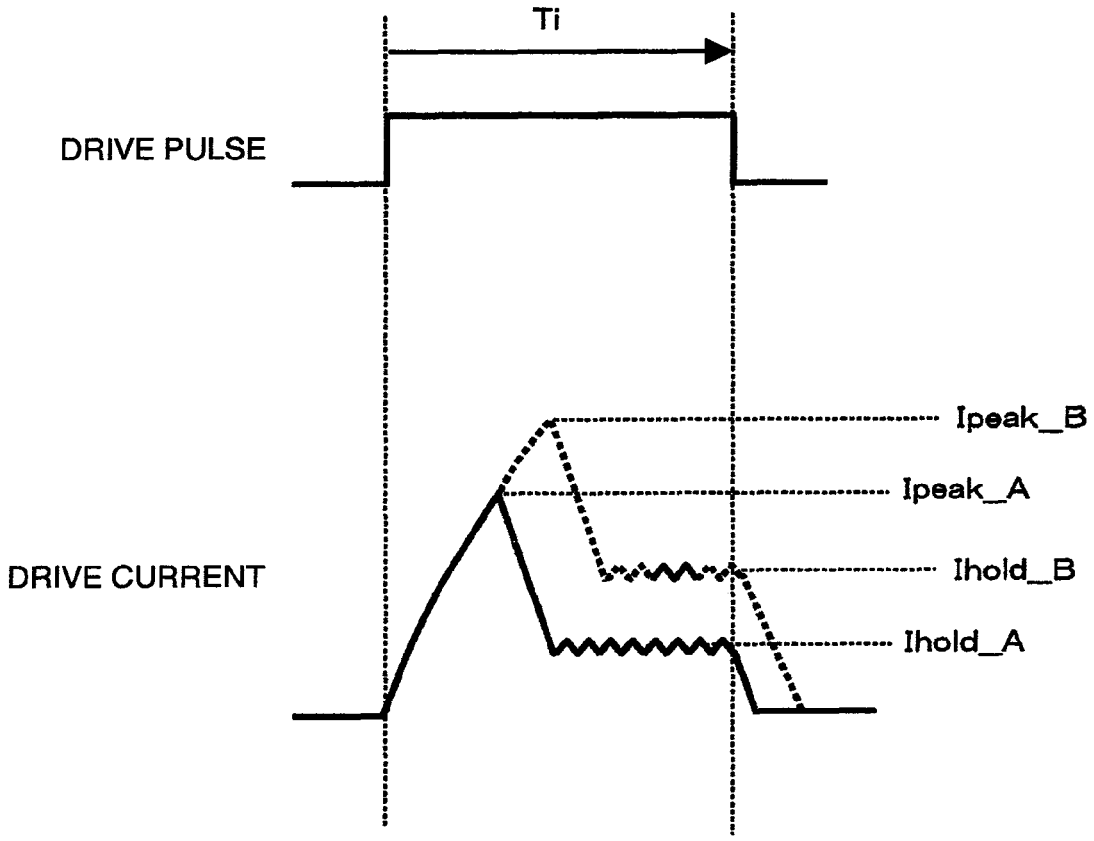
FIG. 10 is a diagram showing a drive current for the injector in the embodiment of the present invention.

A drive current applied to the injector 5 is shown in FIG. 10. A drive pulse width Ti is calculated by the ECU 9. The waveform of a current supplied from the fuel injection controller 27 built in the ECU 9 usually has a peak Ipeak_A for opening the valve and a peak Ihold_A for holding the opened valve. In such a system that can modify the waveform of the current supplied from the fuel injection controller 27 according to a command issued from the ECU 9, while the fuel pressure is high due to a double failure as mentioned above, the valve opening peak current and opened-valve holding peak current can also be increased to Ipeak_B and Ihold_B respectively.

When the fuel pressure is decreased due to the fuel injection of the injectors 5, the discharge efficiency of the high pressure fuel pump 25 is increased to increase a discharge quantity and an injection quantity from the injectors 5 is decreased, as shown in FIG. 5B. Thus, in particular, in a high engine speed range, the discharge quantity is balanced with the injection quantity and the fuel pressure in the high pressure fuel pipe 29 becomes nearly constant, for which reason the quantity of fuel cannot be reduced.

For the purpose of avoiding the aforementioned phenomenon, the operation of the low pressure fuel pump 24 is stopped at a step S230 when a double failure mode is determined at the step S30 of FIG. 8. This is for the purpose of reducing the discharge quantity of the high pressure fuel pump 25 and reducing a quantity of fuel newly supplied into the high pressure fuel pipe by stopping supply of a new fuel from the fuel tank 23 to the high pressure fuel pump 25. As a result, since the injection quantity of the injector 5 becomes larger than the discharge quantity of the high pressure fuel pump 25 at a time T3 or at times subsequent to a time T4 in FIG. 6, the fuel pressure can be reduced. When a double failure mode is not determined at the step S30, the low pressure fuel pump is normally driven at a step S210.

When the operation of the low pressure fuel pump 24 is stopped, fuel supply from the fuel tank is abruptly cut. When the high pressure fuel pump 25 is put in its full discharge state after the double failure, an internal pressure in the low pressure fuel pipe 28 connecting the low pressure fuel pump and the high pressure fuel pump abruptly drops, which may result undesirably in that the low pressure fuel pipe 28 is deformed or damage.

When the control apparatus determines that the fuel pressure is lower than the threshold P_a in FIG. 6 at the step S220 of FIG. 9 (at a time T3 shown in FIG. 6) and that the fuel pump is not lower than the threshold P_c in FIG. 6 at a step S240, it is also considered to stop the operation of the low pressure fuel pump 24 at a step S230.

Even in any of the flow charts of FIGS. 8 and 9, the control apparatus determines at a step S240 that the fuel pressure is decreased down to the threshold P_c, and the low pressure fuel pump 24 is sequentially switched between its operation and stoppage at time points subsequent to a time point T5 at a step S250. Or when the discharge quantity of the low pressure fuel pump 24 can be made variable, the discharge quantity is varied. This is because the high pressure fuel pump 25 cannot control the discharge quantity and thus feedback control toward a target fuel pressure in the double failure mode is carried out by the low pressure fuel pump 24.

How to avoid an abnormally increased pressure when a double failure takes place has been explained above. Meanwhile, explanation will be made as to how to more quickly avoid an abnormally increased pressure by previously carrying out failure diagnosis for the relief valve 30. How to carry out failure diagnosis of the relief valve 30 is considered in various ways. For example, the target fuel pressure in the high pressure fuel pipe 29 calculated by the ECU 9 is set to be temporarily higher than the valve opening pressure of the relief valve 30. When the relief valve 30 is normally operated, a fuel pressure detected by the fuel pressure sensor 26 fails to reach the target fuel pressure and indicates the valve opening pressure of the relief valve 30. When the function of the relief valve 30 is deteriorated, the fuel pressure exceeds the valve opening pressure of the relief valve 30 and reaches the target fuel pressure.

When a failure in the relief valve is detected, the discharge quantity of the low pressure fuel pump 24 is set to be lower than its normal level. As a result, even when such a failure that the high pressure fuel pump 25 cannot control the discharge quantity takes place, the fuel pressure of the high pressure fuel pipe 29 can be quickly reduced.

Simultaneously with the above, when the threshold P_a is changed not to be higher than the valve opening pressure of the relief valve 30, the fuel pressure of the high pressure fuel pipe 29 can be quickly decreased.

The embodiment of the present invention has been explained in detail, but the present invention is not restricted to the aforementioned embodiment. The constituent elements of the present invention are not limited to the aforementioned structures, so long as the elements do not deteriorate the feature functions of the invention.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A control apparatus for an internal combustion engine comprising:

a high pressure fuel pump for supplying a high pressure fuel to the internal combustion engine;

a low pressure fuel pump for supplying the fuel to the high pressure fuel pump;

at least one fuel injector for injecting the fuel directly into a cylinder of the engine;

a fuel injection controller for driving the high pressure fuel pump and the injector;

a high pressure fuel pipe connected between the high pressure fuel pump and the injector, fuel pressure detecting means provided to the high pressure pipe; and a relief valve provided in the high pressure fuel pump or the high pressure fuel pipe, wherein a total of maximum injection quantity of the at least one injector mounted to the engine is set to exceed a maximum discharge quantity of the high pressure fuel pump in a range where the fuel injection controller is normally operated and, when a stuck fault occurs in the relief valve and also the high pressure fuel pump is out of control so that a fuel pressure detected by the fuel pressure detecting means is a certain threshold value P_a or more, the fuel injection controller controls a valve opened time duration in such a manner that a total of injection quantity per unit time injected from the injector is larger than a fuel discharge quantity per unit time discharged from the high pressure fuel pump and inhibits stoppage of fuel injection from the fuel injector, when a fuel pressure detected by the fuel pressure detecting means is equal or lower than a predetermined threshold value which is not more than the threshold value P_a, the low pressure fuel pump is stopped.

2. The control apparatus according to claim 1, wherein, when a fuel pressure detected by the fuel pressure detecting means is smaller than a certain threshold value P_b which is not larger than the threshold value P_a, the fuel injection controller returns a valve opening time duration of the injector to its normal value.

3. The control apparatus according to claim 1, wherein the fuel injection controller returns a valve opening time duration of the injector to its normal value after stoppage of the low pressure fuel pump and immediately after passage of the predetermined time duration.

4. The control apparatus according to claim 1, wherein when a fuel pressure detected by the fuel pressure detecting means is smaller than a certain threshold value P_c which is not larger than the threshold value P_a, the fuel injection controller switches the low pressure fuel pump between its operation and stoppage on the basis of a difference between a fuel pressure detected by the fuel pressure detecting means and a target fuel pressure.

5. The control apparatus according to claim 1, wherein when a failure is detected in the relief valve, a discharge quantity of the low pressure fuel pump is set at a value smaller than its normal value.

6. The control apparatus according to claim 1, wherein when a failure is detected in the relief valve, the threshold value P_a is changed to a value not larger than the valve opening pressure of the relief valve.

* * * * *